US010578087B2

(12) United States Patent
Kume et al.

(10) Patent No.: US 10,578,087 B2
(45) Date of Patent: Mar. 3, 2020

(54) VARIABLE-CAPACITY COMPRESSOR CONTROL VALVE

(71) Applicant: Fujikoki Corporation, Setagaya-ku, Tokyo (JP)

(72) Inventors: Yoshiyuki Kume, Tokyo (JP); Hisashi Asano, Tokyo (JP); Masaki Tomaru, Tokyo (JP); Masaharu Itoh, Tokyo (JP)

(73) Assignee: Fujikoki Corporation, Tokyo (JP)

( * ) Notice: Subject to any disclaimer, the term of this patent is extended or adjusted under 35 U.S.C. 154(b) by 230 days.

(21) Appl. No.: 15/372,763

(22) Filed: Dec. 8, 2016

(65) Prior Publication Data

US 2017/0175723 A1 Jun. 22, 2017

(30) Foreign Application Priority Data

Dec. 16, 2015 (JP) ..... 2015-244966

(51) Int. Cl.
*F04B 27/18* (2006.01)

(52) U.S. Cl.
CPC .. *F04B 27/1804* (2013.01); *F04B 2027/1827* (2013.01); *F04B 2027/1845* (2013.01)

(58) Field of Classification Search
CPC ..... F04B 27/1804; F04B 2027/1859; F04B 2027/1854; F04B 2027/1827;
(Continued)

(56) References Cited

U.S. PATENT DOCUMENTS 5,046,530 A * 9/1991 Gossner ..... F16K 31/0693 137/596.17
2004/0217550 A1* 11/2004 Lee ..... F16J 9/10 277/459

(Continued)

FOREIGN PATENT DOCUMENTS

CN 1605780 4/2005
EP 1522728 4/2005

(Continued)

OTHER PUBLICATIONS

Japanese Office Action dated May 22, 2018 relating to co-pending Japanese Application No. 2015-244966 with Englih translation, 6 Pages.

(Continued)

*Primary Examiner* — Patrick Hamo
*Assistant Examiner* — David N Brandt
(74) *Attorney, Agent, or Firm* — McCarter & English, LLP

(57) ABSTRACT

Provided is a variable-capacity compressor control valve that can suppress a decrease in the efficiency by reducing the amount of leakage in the valve without requiring severe accuracy of the components, avoid possible operation failures, and suppress the influence on the sliding resistance as well as the influence on the control characteristics. A main valve element of a valve element or a valve body is provided with a flexible or elastic sealing member. The sealing member is adapted to, when the valve orifice is closed by the main valve element, abut an end portion on the higher pressure side in a gap between sliding surfaces that is formed between the main valve element and a guide hole into which the main valve element is adapted to be slidably fitted and inserted, and thus seal the gap between the sliding surfaces.

19 Claims, 13 Drawing Sheets

(58) Field of Classification Search
CPC ..... F04B 2027/1813; F04B 2027/1845; F04B 27/1813; F04B 27/1827; F16J 9/00; F16J 9/12
See application file for complete search history.

(56) References Cited

U.S. PATENT DOCUMENTS

| | | | | |
|---|---|---|---|---|
| 2005/0077493 | A1 | 4/2005 | Okada | |
| 2005/0201867 | A1* | 9/2005 | Hirota | F04B 27/1804 417/222.2 |
| 2012/0056113 | A1* | 3/2012 | Tano | F04B 27/1804 251/25 |
| 2016/0319808 | A1* | 11/2016 | Shaw | F04B 17/03 |

FOREIGN PATENT DOCUMENTS

| | | |
|---|---|---|
| EP | 2657627 | 10/2013 |
| JP | 61-85775 | 6/1986 |
| JP | 2-245585 | 10/1990 |
| JP | 2004-332856 | 11/2004 |
| JP | 2005-212004 | 8/2005 |
| JP | 2010-185285 | 8/2010 |
| JP | 2011-43102 | 3/2011 |
| JP | 2013-130126 | 7/2013 |
| WO | 2008108093 | 9/2008 |

OTHER PUBLICATIONS

European Search Report based on co-pending European Application No. 16195692.5, dated May 8, 2017, 4 Pages.
Chinese Office Action dated Apr. 29, 2019 based on co-pending Chinese Application No. 201611144974.2—8 Pages.

* cited by examiner

X-X cross-section

Y-Y cross-section

[ Normal operation time (Main valve element: Open, Sub valve element: Closed) ]

[ Time of transition to compressor actuation (Main valve element: Closed, Sub valve element: Closed) ]
[ Compressor actuation time (Main valve element: Closed, Sub valve element: Open) ]

[Normal control time]

[Compressor actuation time]

VARIABLE-CAPACITY COMPRESSOR CONTROL VALVE

CLAIM OF PRIORITY

The present application claims priority from Japanese patent application JP 2015-244966 filed on Dec. 16, 2015, the content of which is hereby incorporated by reference into this application.

BACKGROUND

Technical Field

The present invention relates to a variable-capacity compressor control valve for use in an automotive air conditioner or the like.

Background Art

Conventionally, a variable-capacity swash plate compressor such as the one schematically shown in FIG. 10 has been used as a compressor for an automotive air conditioner. The variable-capacity swash plate compressor 100 includes a rotating shaft 101 that is rotationally driven by an on-vehicle engine, a swash plate 102 that is attached to the rotating shaft 101, a crank chamber 104 in which the swash plate 102 is disposed, a piston 105 that is reciprocated by the swash plate 102, a discharge chamber 106 for discharging refrigerant compressed by the piston 105, a suction chamber 107 for sucking refrigerant, an in-compressor release passage (fixed orifice) 108 for releasing a pressure Pc in the crank chamber 104 to the suction chamber 107, and the like.

Meanwhile, a control valve 1' used for the aforementioned variable-capacity compressor receives the discharge pressure Pd from the discharge chamber 106 of the compressor 100 and is configured to control the pressure Pc in the crank chamber 104 by controlling the discharge pressure Pd in accordance with the suction pressure Ps of the compressor 100. Such a control valve 1' has, as the basic configuration, a valve body that includes a valve chamber with a valve orifice, a Ps introduction port communicating with the suction chamber 107 of the compressor 100, a Pd introduction port arranged upstream of the valve orifice and communicating with the discharge chamber 106 of the compressor 100, and a Pc outlet port arranged downstream of the valve orifice and communicating with the crank chamber 104 of the compressor 100; a valve element (valve stem) for opening or closing the valve orifice; an electromagnetic actuator with a plunger for moving the valve element in the direction to open or close the valve orifice (in the vertical direction); a pressure-sensitive chamber that receives the suction pressure Ps from the compressor 100 via the Ps introduction port; and a pressure-sensitive reaction member that urges the valve element in the direction to open or close the valve orifice in accordance with the pressure in the pressure-sensitive chamber. The valve element and the valve orifice form a valve unit indicated by reference numeral 11' in FIG. 10 (for example, see Patent Document 1 below).

In the control valve 1' with such a configuration, when current is flowed through a solenoid portion including a coil, a stator, an attractor, and the like of the electromagnetic actuator, the plunger is attracted by the attractor, and along with this, the valve element is moved in the direction to close the valve such that it follows the plunger by the urging force of a valve closing spring. Meanwhile, the suction pressure Ps introduced from the compressor 100 via the Ps introduction port is introduced into the pressure-sensitive chamber from an inlet/outlet chamber via a gap formed between the plunger and a guide pipe arranged around the outer periphery of the plunger or the like. Then, the pressure-sensitive reaction member (e.g., a bellows device) is expansively or contractively displaced in accordance with the pressure (suction pressure Ps) in the pressure-sensitive chamber (contracts if the suction pressure Ps is high, and expands if it is low), and the displacement (urging force) is then transmitted to the valve element, whereby the valve element portion of the valve element moves up or down with respect to the valve orifice to regulate the valve opening of the valve unit 11'. That is, the valve opening is determined by the force of attracting the plunger with the solenoid portion, the urging force (expansion or contraction force) that acts with the expansive or contractive displacement of the pressure-sensitive reaction member, the urging force of a plunger spring (valve opening spring) and the valve closing spring. The pressure Pc in the crank chamber 104 (hereinafter also referred to as a crank chamber pressure Pc or simply referred to as a pressure Pc) is controlled in accordance with the valve opening.

In response to the aforementioned variable-capacity compressor, an improved variable-capacity swash plate compressor, such as the one schematically shown in FIGS. 11A and 11B, for example, has already been proposed that is intended to reduce the time required to increase the discharge capacity at the compressor actuation time, and suppress or reduce a decrease in the operation efficiency of the compressor at the normal control time.

A control valve 2' used for such an improved variable-capacity swash plate compressor 200 has a valve element (valve stem) including a main valve element and a sub valve element, and has an in-valve release passage 16' in the main valve element. The control valve 2' basically has a valve body that includes a valve chamber with a valve orifice, a Ps inlet/outlet port communicating with a suction chamber 107 of the compressor 200, a Pd introduction port arranged upstream of the valve orifice and communicating with a discharge chamber 106 of the compressor 200, and a Pc inlet/outlet port arranged downstream of the valve orifice and communicating with a crank chamber 104 of the compressor 200; a main valve element for opening or closing the valve orifice; an electromagnetic actuator with a plunger for moving the main valve element in the direction to open or close the valve orifice; a pressure-sensitive chamber that receives the suction pressure Ps from the compressor 200 via the Ps inlet/outlet port; and a pressure-sensitive reaction member that urges the main valve element in the direction to open or close the valve orifice in accordance with the pressure in the pressure-sensitive chamber. Further, the in-valve release passage 16' for releasing the pressure Pc in the crank chamber 104 to the suction chamber 107 of the compressor 200 via the Ps inlet/outlet port is provided in the main valve element, and the sub valve element for opening or closing the in-valve release passage 16' is also provided so that when the plunger is continuously moved upward from the lowest position by the attraction force of the electromagnetic actuator, the sub valve element moves upward together with the plunger while closing the in-valve release passage 16', and the main valve element is also moved upward so as to follow the sub valve element. Then, after the valve orifice is closed by the main valve element, if the plunger is further moved upward, the sub valve element is configured to open the in-valve release passage 16'. The main valve element and the valve orifice form a main valve unit indicated by reference numeral 11' in FIGS.

11A and 11B, while the sub valve element and the in-valve release passage form a sub valve unit indicated by reference numeral 12' (for example, see Patent Document 2 below).

At the normal control time (Pd→Pc control time) of the control valve 2' with such a configuration, when current is flowed through a solenoid portion including a coil, a stator, an attractor, and the like of the electromagnetic actuator, the plunger is attracted by the attractor, and along with this, the sub valve element moves upward integrally with the plunger, and following the movement of the sub valve element, the main valve element is moved in the direction to close the valve by the urging force of a valve closing spring. Meanwhile, the suction pressure Ps introduced from the compressor 200 via the Ps inlet/outlet port is introduced into the pressure-sensitive chamber from an inlet/outlet chamber via a horizontal hole in the plunger or the like, and the pressure-sensitive reaction member (e.g., a bellows device) is expansively or contractively displaced in accordance with the pressure (suction pressure Ps) in the pressure-sensitive chamber (contracts if the suction pressure Ps is high, and expands if it is low), and the displacement (urging force) is then transmitted to the main valve element, whereby the main valve element portion of the main valve element moves up or down with respect to the valve orifice to regulate the valve opening of the main valve unit 11'. That is, the valve opening is determined by the force of attracting the plunger with the solenoid portion, the urging force (expansion or contraction force) that acts with the expansive or contractive displacement of the pressure-sensitive reaction member, the urging force of a plunger spring (valve opening spring) and the valve closing spring, and force that acts on the main valve element in the valve opening direction and in the valve closing direction. The pressure Pc in the crank chamber 104 is controlled in accordance with the valve opening. In such a case, the main valve element is always urged upward by the urging force of the valve closing spring, while the sub valve element is always urged downward by the urging force of the valve opening spring. Thus, the sub valve unit 12' is closed and the in-valve release passage 16' is blocked in the main valve element. Therefore, there is no possibility that the crank chamber pressure Pc may be released to the suction chamber 107 via the in-valve release passage 16'.

In contrast, at the compressor actuation time, current is flowed through the solenoid portion so that the plunger is attracted by the attractor and the sub valve element moves upward together with the plunger. Following the upward movement of the sub valve element, the main valve element is moved in the direction to close the valve by the urging force of the valve closing spring, and after the valve orifice is closed by the main valve element portion of the main valve element, the plunger is further moved upward, whereby the sub valve element opens the in-valve release passage 16'. Then, the crank chamber pressure Pc is released to the suction chamber 107 via two passages that are an in-compressor release passage 108 and the in-valve release passage 16' (for details, see Patent Document 2 below and the like).

RELATED ART DOCUMENTS

Patent Documents

Patent Document 1: JP 2010-185285 A

Patent Document 2: JP 2013-130126 A

Patent Document 3: JP 2011-043102 A

SUMMARY

By the way, in a variety of types of variable-capacity compressor control valves descried above, it is desired to reduce the amount of leakage in the valve by sealing a gap (clearance) between sliding surfaces that is formed between a valve element (or the outer peripheral surface thereof) and a guide hole (or the inner wall surface thereof) into which the valve element is adapted to be slidably fitted and inserted, and avoid a circumstance in which the gap (clearance) between the sliding surfaces is clogged with foreign matter, which would stop the motion of the valve element (operation failures such as a locked valve or a valve element that is left behind). In response to such a demand, it has been proposed to dispose a sealing member (O-ring), which is formed of a flexible annular body and adapted to be arranged around a valve element, between the valve element and the guide hole (for example, see Patent Document 3 above).

However, when a sealing member such as an O-ring is disposed between a valve element and a guide hole, there have been problems in that the accuracy of the components should be increased to suppress the sliding resistance, or the sliding resistance will change due to the deformation of the sealing member in accordance with the pressure difference (for example, if the pressure difference becomes large, the sealing member will greatly deform, which in turn will increase the sliding resistance), and further, the control characteristics will deteriorate (hysteresis will increase).

The present invention has been made in view of the foregoing, and it is an object of the present invention to provide a variable-capacity compressor control valve that can suppress a decrease in the efficiency by reducing the amount of leakage in the valve without requiring severe accuracy of the components, avoid possible operation failures, and suppress the influence on the sliding resistance as well as the influence on the control characteristics.

In order to achieve the aforementioned object, a variable-capacity compressor control valve in accordance with the present invention basically includes a valve body including a valve chamber with a valve orifice, a Ps inlet/outlet port communicating with a suction chamber of a compressor, a Pd introduction port arranged upstream of the valve orifice and communicating with a discharge chamber of the compressor, and a Pc inlet/outlet port arranged downstream of the valve orifice and communicating with a crank chamber of the compressor; a valve element adapted to open or close the valve orifice; an electromagnetic actuator with a plunger for moving the valve element in a direction to open or close the valve orifice; a pressure-sensitive chamber adapted to receive a suction pressure Ps from the compressor via the Ps inlet/outlet port; and a pressure-sensitive reaction member adapted to urge the valve element in the direction to open or close the valve orifice in accordance with a pressure in the pressure-sensitive chamber. The valve element is adapted to be slidably fitted and inserted into a guide hole provided in the valve body, and one of the valve element or the valve body is provided with a flexible or elastic sealing member, the sealing member being adapted to, when the valve orifice is closed by the valve element, abut an end portion on a higher pressure side in a gap between sliding surfaces that is formed between the valve element and the guide hole, and thus seal the gap between the sliding surfaces.

In a preferred aspect, the sealing member is disposed in an annular groove, the annular groove being provided around an outer periphery of the valve element.

In a further preferred aspect, the sealing member has a ring shape in which an inner peripheral portion of the sealing member is embedded in the annular groove and an outer peripheral portion of the sealing member protrudes from the annular groove.

The sealing member preferably has at least one cut-in formed in its inner peripheral portion.

The sealing member preferably has a partially cut-off portion in its circumferential direction.

In another preferred aspect, the sealing member is vertically movably disposed in the annular groove.

In still another preferred aspect, the sealing member is disposed on the valve body.

In a further preferred aspect, the sealing member has a ring shape in which an inner peripheral portion of the sealing member is embedded in the annular groove that is provided around the outer periphery of the valve element, and an outer peripheral portion of the sealing member is attached to the valve body.

The sealing member preferably has at least one cut-in formed in its inner peripheral portion.

The sealing member preferably has a partially cut-off portion in its circumferential direction.

In another preferred aspect, the sealing member is fixed to the valve body or is vertically movably disposed on the valve body.

In still another preferred aspect, the end portion on the higher pressure side in the gap between the sliding surfaces has a planar portion, and the sealing member is adapted to abut the planar portion.

In further another preferred aspect, the sealing member is adapted to be separated from the end portion on the higher pressure side in the gap between the sliding surfaces when the valve orifice is open.

In yet another preferred aspect, the valve element includes a main valve element and a sub valve element, the main valve element being adapted to open or close the valve orifice and having formed therein an in-valve release passage for releasing a pressure Pc in the crank chamber to the suction chamber of the compressor via the Ps inlet/outlet port, and the sub valve element being adapted to open or close the in-valve release passage. The sealing member is disposed on one of the valve body or the main valve element that is adapted to be fitted and inserted into the guide hole.

According to the variable-capacity compressor control valve in accordance with the present invention, a valve element or a valve body is provided with a flexible or elastic sealing member that is adapted to, when a valve orifice is closed by the valve element, abut an end portion on the higher pressure side in a gap between sliding surfaces that is formed between the valve element and a guide hole into which the valve element is adapted to be slidably fitted and inserted, and thus seal the gap between the sliding surfaces. Therefore, in comparison with the conventional art in which a sealing member such as an O-ring is disposed between a valve element and a guide hole, it is possible to suppress a decrease in the efficiency by reducing the amount of leakage in the valve without requiring severe accuracy of the components, avoid possible operation failures, such as a locked valve or a valve element that is left behind, and suppress the influence on the sliding resistance as well as the influence on the control characteristics.

BRIEF DESCRIPTION OF THE DRAWINGS

FIG. 4A is a front view, FIG. 4B is a left-side view, FIG. 4C is a bottom view, FIG. 4D is a sectional view along the direction of the arrows X-X in FIG. 4A, and FIG. 4E is a sectional view along the direction of the arrows Y-Y in FIG. 4B.

FIG. 6A is a longitudinal sectional view at the normal control time, and FIG. 6B is a longitudinal sectional view at the time of transition to compressor actuation and the compressor actuation time.

FIG. 11A is a view of the normal operation time and FIG. 11B is a view of the compressor actuation time.

DETAILED DESCRIPTION

Hereinafter, embodiments of the present invention will be described with reference to the drawings.

First Embodiment

Figure 1:
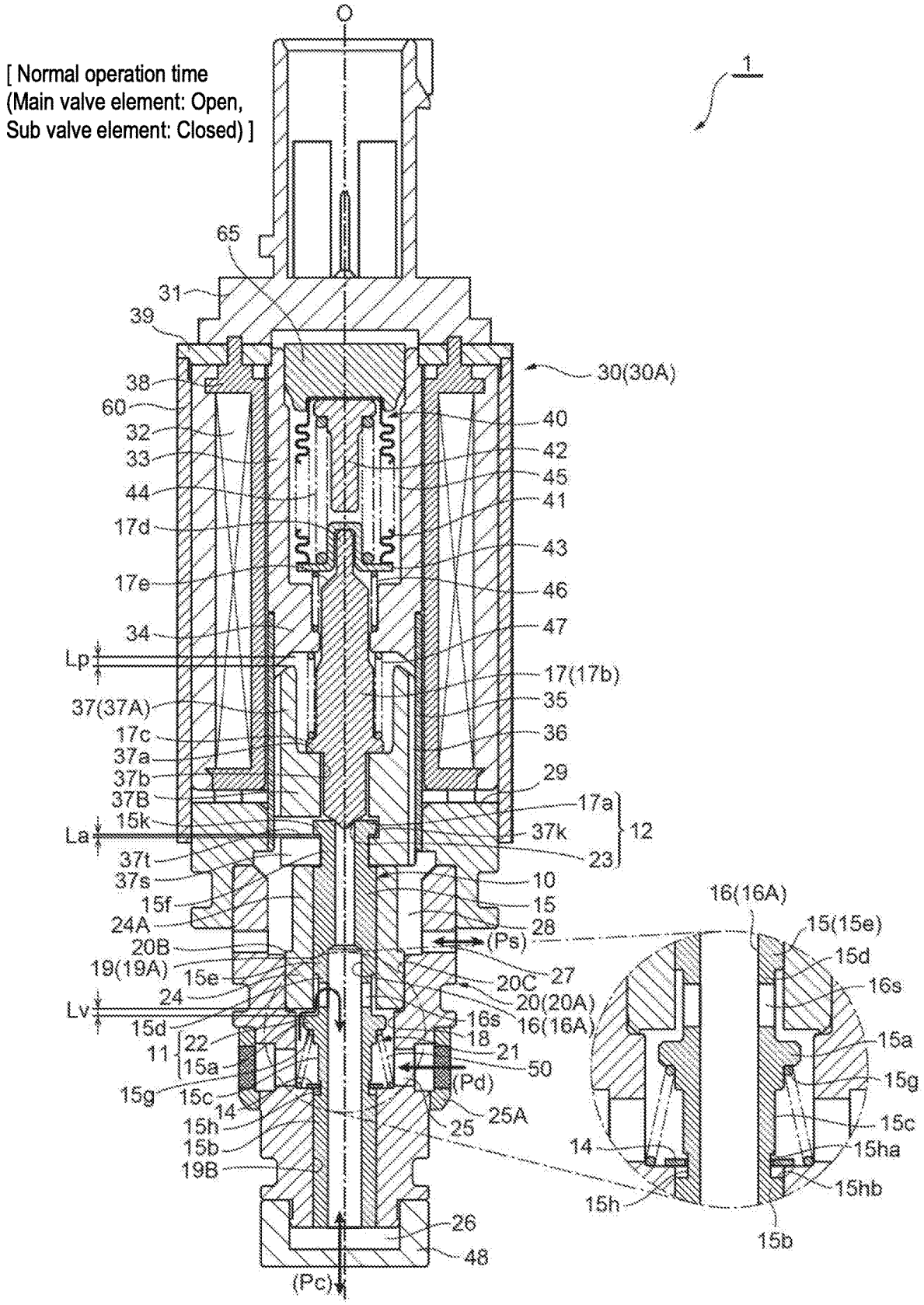
FIG. 1 is a longitudinal sectional view showing the first embodiment of the variable-capacity compressor control valve in accordance with the present invention in which the main valve element is in the open position and the sub valve element is in the closed position (at the normal control time).
Figure 2:
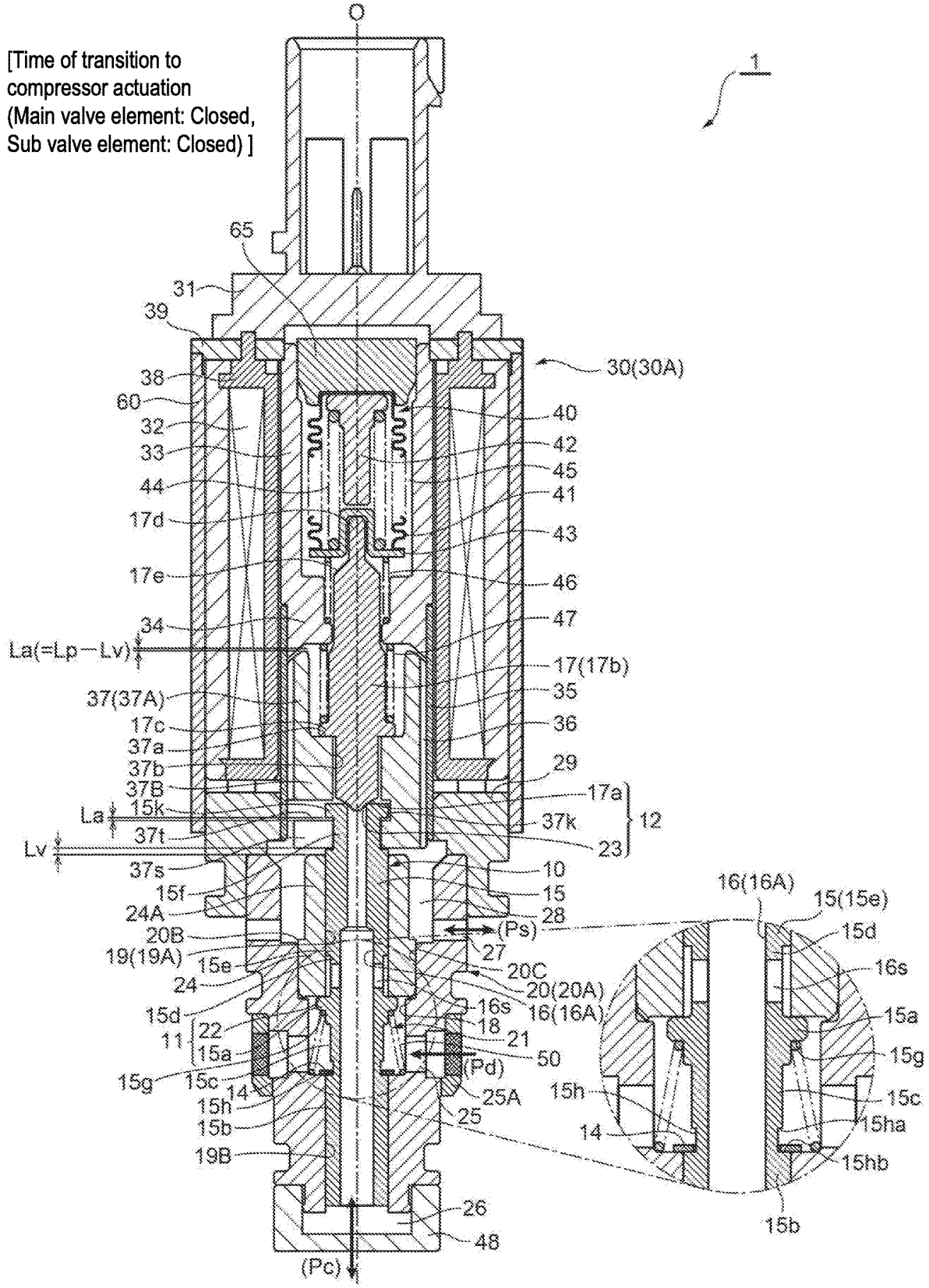
FIG. 2 is a longitudinal sectional view showing the first embodiment of the variable-capacity compressor control valve in accordance with the present invention in which the main valve element is in the closed position and the sub valve element is in the closed position (at the time of transition to compressor actuation).
Figure 3:
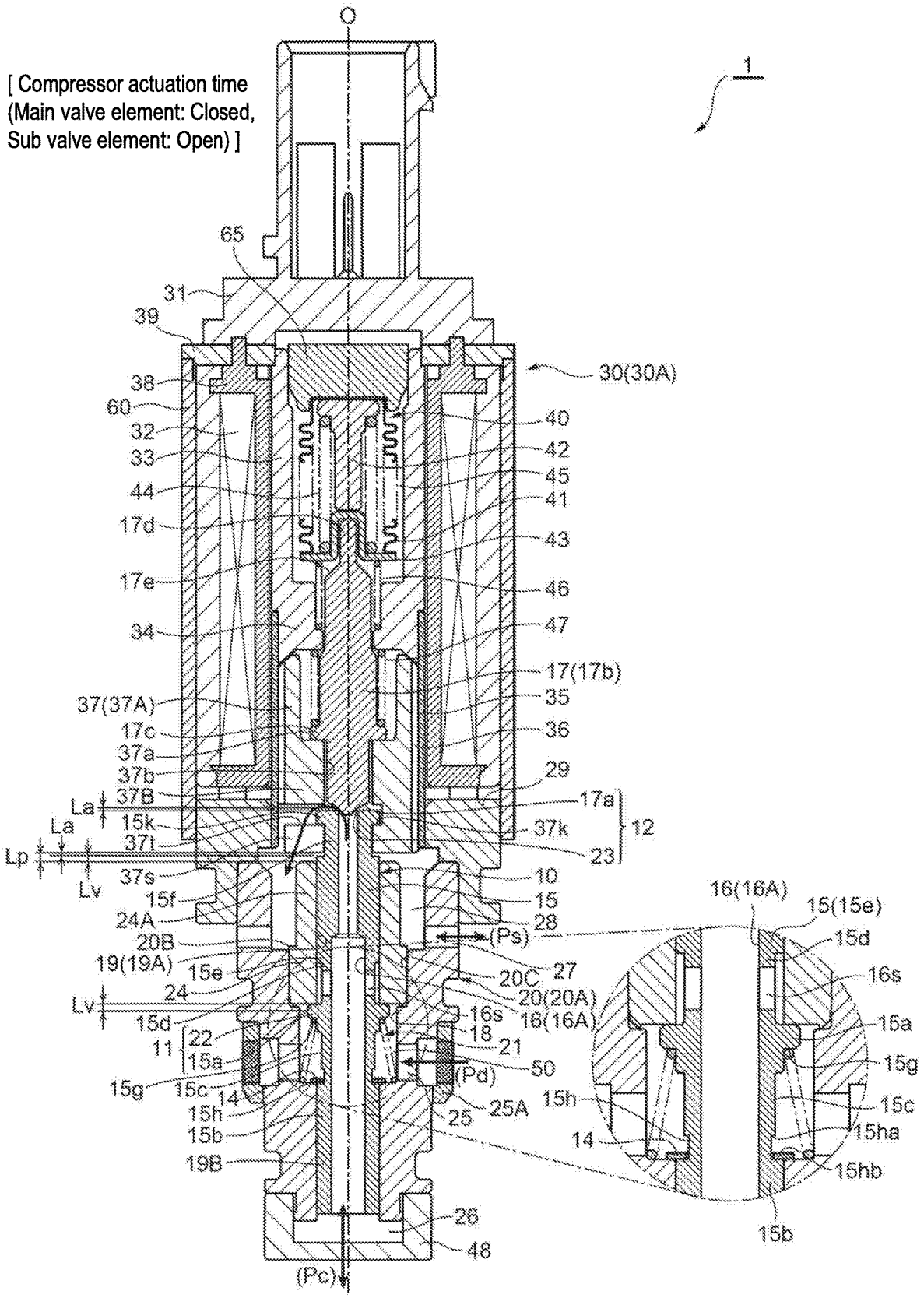
FIG. 3 is a longitudinal sectional view showing the first embodiment of the variable-capacity compressor control valve in accordance with the present invention in which the main valve element is in the closed position and the sub valve element is in the open position (at the compressor actuation time).
Figure 4A:
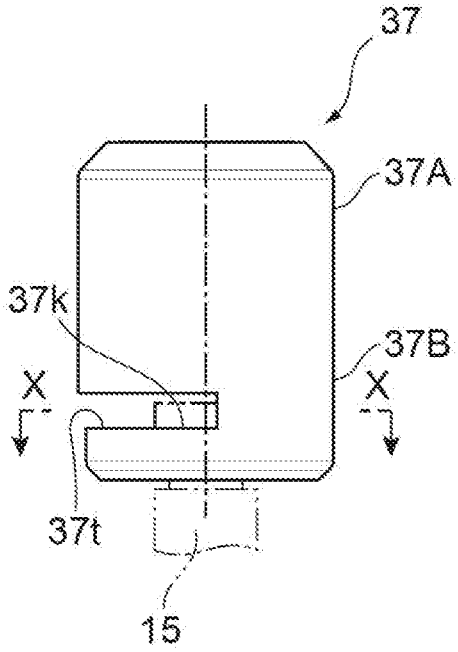
FIGS. 4A to 4E are views each showing a plunger used for the variable-capacity compressor control valve in accordance with the present invention; specifically.
Figure 4B:
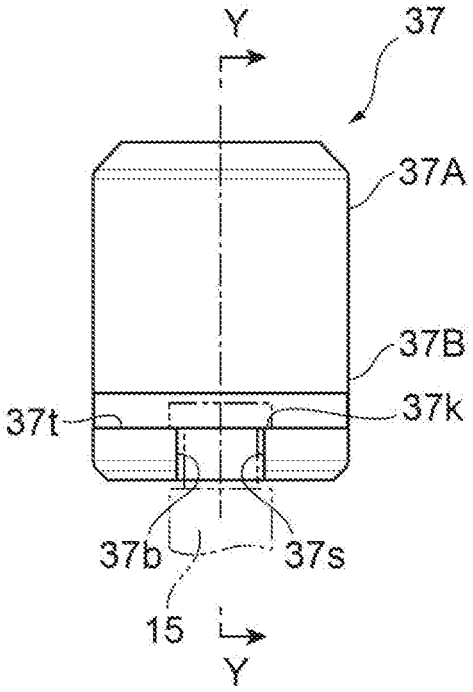
Figure 4C:
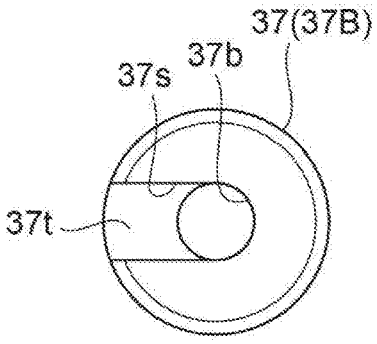
Figure 4D:
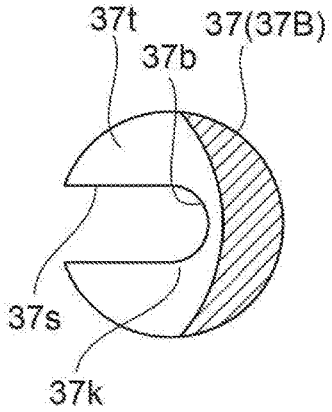
Figure 4E:
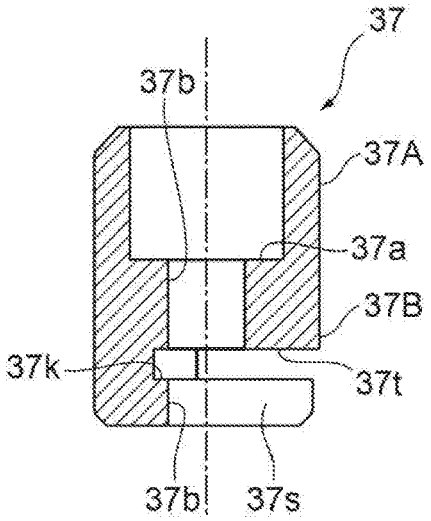

FIGS. 1 to 3 are longitudinal sectional views each showing the first embodiment of the variable-capacity compressor control valve in accordance with the present invention. Specifically, FIG. 1 is a view in which the main valve element is in the open position and the sub valve element is in the closed position (at the normal control time), FIG. 2 is a view in which the main valve element is in the closed position and the sub valve element is in the closed position (at the time of transition to compressor actuation), and FIG. 3 is a view in which the main valve element is in the closed position and the sub valve element is in the open position (at the compressor actuation time).

It should be noted that in the present specification, descriptions indicating the positions or directions, such as upper, lower, top, bottom, left, right, front, and rear, are used for the sake of convenience in accordance with the drawings to avoid complexity in the description, but such descriptions do not necessarily indicate the actual positions or directions when the control valve of the present invention is incorporated into a compressor.

In addition, in each drawing, a gap formed between members, a clearance between members, and the like may be depicted larger or smaller than their actual dimensions to help understand the present invention and also for the sake of convenience to create the drawing.

A control valve 1 in the shown embodiment has a valve body 20 with a valve orifice 22; a valve element 10 with a main valve element 15 for opening or closing the valve orifice 22; an electromagnetic actuator 30 for moving the valve element 10 (main valve element 15) in the direction to open or close the valve orifice (in the vertical direction); and a bellows device 40 that serves as a pressure-sensitive reaction member.

The electromagnetic actuator 30 includes a bobbin 38, an energization coil 32 wound around the bobbin 38, a connector head 31 attached to the upper side of the bobbin 38 with an attachment plate 39 interposed therebetween, a stator 33 and an attractor 34 arranged on the inner peripheral side of the coil 32, a guide pipe 35 whose upper end portion is joined by welding to the outer periphery of the lower end portion (a step portion) of the stator 33 and the attractor 34, a plunger 37 having a recessed cross section and arranged vertically slidably on the inner peripheral side of the guide pipe 35 below the attractor 34, a cylindrical housing 60 externally arranged around the coil 32, and a holder 29 arranged between the lower end portion of the housing 60 and the guide pipe 35 and adapted to fix them to the top of the valve body 20. In the present example, the attractor 34 with a recessed cross section is integrally molded with the inner periphery of the bottom of the cylindrical stator 33. Herein, a portion of the electromagnetic actuator 30 including the coil 32, the stator 33, the attractor 34, and the like and excluding the plunger 37 is referred to as a solenoid portion 30A.

A stator 65 in a short columnar shape is attached to the top of the stator 33 by press fitting or the like, and a pressure-sensitive chamber 45, which receives a suction pressure Ps in a compressor 100, is formed between the stator 65 and the attractor 34 on the inner peripheral side of the stator 33. The pressure-sensitive chamber 45 has arranged therein the bellows device 40 that serves as a pressure-sensitive reaction member and includes bellows 41, an upper stopper 42 in an inverted projection shape, a lower stopper 43 in an inverted recessed shape, and a compression coil spring 44. Further, a top small-diameter portion 17*d* (an end portion on the side opposite to a sub valve element portion 17*a*) of a sub valve element 17 described below is fitted and inserted in and supported by the recess of the lower stopper 43, and a compression coil spring 46, which urges the bellows device 40 in the direction to contract the bellows device 40, is provided in a compressed state between the lower stopper 43 and the attractor 34.

The plunger 37 has a cylindrical upper half portion 37A and a columnar lower half portion 37B. Provided in the center of the columnar lower half portion 37B is an insertion hole 37*b* through which a waist portion 17*b* of the sub valve element 17 that extends downward through the attractor 34 and a top small-diameter portion 15*f* (described in detail below) of the main valve element 15 are inserted. The outer peripheral portion of the insertion hole 37*b* on the upper surface of the columnar lower half portion 37B serves as a latch portion 37*a* to which an intermediate large-diameter latch portion 17*c* of the sub valve element 17 is latched.

In addition, a plunger spring (valve opening spring) 47 constructed from a cylindrical compression coil spring, which urges the sub valve element 17 and the plunger 37 downward (in the direction to open the valve), is provided in a compressed state between the attractor 34 and the intermediate large-diameter latch portion 17*c* of the sub valve element 17 (plunger 37) so that the sub valve element 17 (or the intermediate large-diameter latch portion 17*c* thereof) is pressed against the plunger 37 by the plunger spring 47 and thus is caused to move up or down with the plunger 37.

Further, as can be understood well from FIGS. 4A to 4E, the bottom of the columnar lower half portion 37B of the plunger 37 (a portion that is above the lower end portion by a predetermined distance) has a cut-in 37*t* with an approximately semicircular shape in plan view (in the horizontal direction) that is formed so as to overlap the insertion hole 37*b*. On the side below the cut-in 37*t* (i.e., at a portion between the cut-in 37*t* and the lower end portion of the columnar lower half portion 37B), a slit 37*s* with approximately the same width as the hole diameter of the insertion hole 37*b* is formed that extends linearly from the edge portion at the lower end of the columnar lower half portion 37B to the insertion hole 37*b*. The height (in the vertical direction) of the cut-in 37*t* is slightly larger than the height of a flanged latch portion 15*k* of the main valve element 15, and the height (in the vertical direction) of the slit 37*s* is slightly smaller than the height of the top small-diameter portion 15*f* of the main valve element 15. The main valve element 15 is movable in the vertical direction with respect to the plunger 37 (which will be described in detail below). The width (in the horizontal direction) of the slit 37*s* is set slightly larger than the outside diameter of the top small-diameter portion 15*f* of the main valve element 15 and smaller than the outside diameter of the flanged latch portion 15*k* of the main valve element 15 taking into consideration the assembling properties and the like.

The valve element 10 has the main valve element 15 and the sub valve element 17 arranged in the vertical direction (along the direction of the axial line O).

The main valve element 15 arranged on the lower side has, sequentially arranged from the bottom side, a bottom fit-insertion portion 15*b*, a lower small-diameter portion 15*c*, a main valve element portion 15*a*, an intermediate small-diameter portion 15*d*, a top fit-insertion portion 15*e*, the top small-diameter portion 15*f*, and the flanged latch portion 15*k*. A stepped release through-hole 16A forming part of an in-valve release passage 16 is provided in the center of the main valve element 15 such that it penetrates the center of the main valve element 15 in the vertical direction, and the upper end portion of the release through-hole 16A serves as a sub valve seat portion 23 with/from which the lower end portion (sub valve element portion) 17*a* of the sub valve element 17 is moved into contact or away. The intermediate small-diameter portion 15*d* of the main valve element 15 has a plurality of horizontal holes 16*s*.

The top small-diameter portion 15*f* of the main valve element 15 is loosely fitted in the insertion hole 37*b* (or a portion below the cut-in 37*t* thereof), and the flanged latch portion 15*k* of the main valve element 15 has a larger diameter than that of the insertion hole 37*b* so that when the plunger 37 is moved upward with respect to the main valve element 15, the flanged latch portion 15*k* is lathed to an inner flanged latch portion 37*k* that is formed by the outer peripheral portion of the insertion hole 37*b*, and thus, latching is achieved and slippage is prevented.

In addition, an annular groove 15*h* with a predetermined width in the vertical direction is provided around the outer periphery of the upper end of the bottom fit-insertion portion 15*b* (or the outer periphery of the lower end of the lower small-diameter portion 15*c*) of the main valve element 15, and a sealing member (packing) 14 in a thin ring shape produced from a flexible material or an elastic material, such as Teflon (registered trademark) or rubber, is vertically movably disposed in the annular groove 15*h*.

In the present example, the annular groove 15*h* is formed such that when the valve orifice 22 is in the fully open state (when the main valve element 15 is at the lowest position, see FIG. 1), an upper surface 15*ha* of the annular groove 15*h* is located above the bottom surface (planar portion) of the reception hole 18 of the valve body 20 by an amount corresponding to the thickness of the sealing member 14, and when the valve orifice 22 is closed (when the main valve element 15 is at the highest elevated position, see FIGS. 2 and 3), a lower surface 15*hb* of the annular groove 15*h* is substantially flush with the bottom surface (planar portion) of the reception hole 18. In addition, the flexible or elastic sealing member 14 is disposed in the annular groove 15*h* such that the inner peripheral portion thereof is embedded in the annular groove 15*h* and the outer peripheral portion thereof protrudes from the annular groove 15*h*.

Figure 5A:
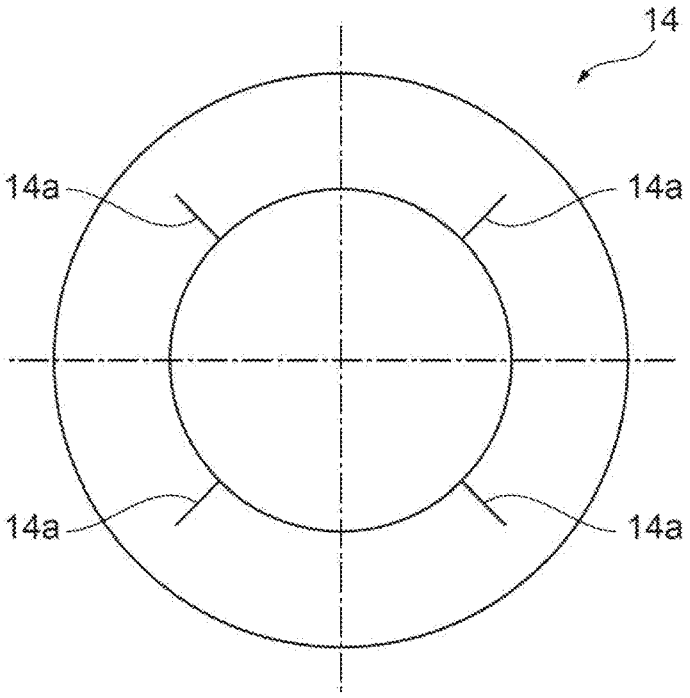
FIGS. 5A and 5B are plan views showing examples of a sealing member in the first embodiment.
Figure 5B:
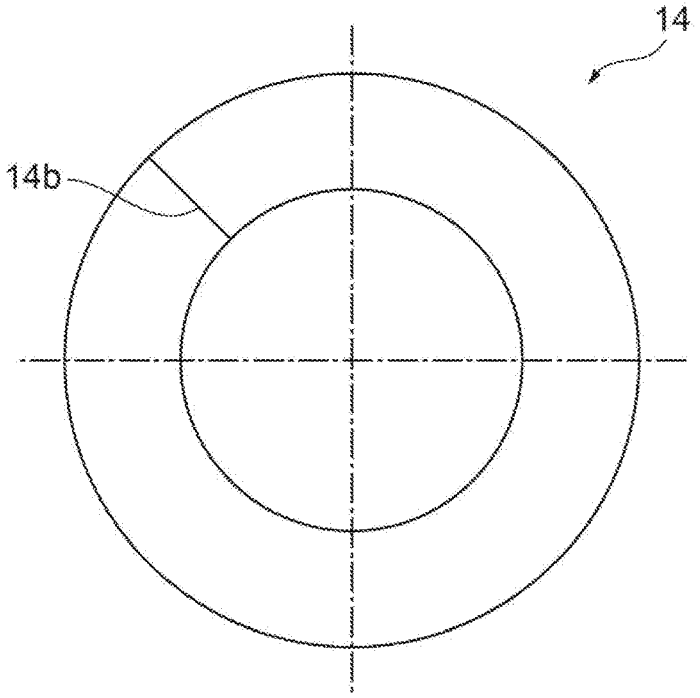

Herein, the scaling member 14 may be provided with, taking into consideration the attachability thereof to the main valve element 15 (or the annular groove 15*h* thereof), at least one cut-in 14*a* formed in its inner peripheral portion as shown in FIG. 5A, for example (four equiangular cut-ins 14*a* in the shown example), or a partially cut-off portion (point) formed in its circumferential direction (a cut-off portion 14*b*) as shown in FIG. 5B. Alternatively, when the sealing member 14 is produced from a material with relatively high elasticity such as rubber, for example, the cut-ins 14*a* and the cut-off portion 14*b* may be omitted.

The sub valve element 17 arranged above the main valve element 15 has, sequentially arranged from the bottom side, an inverted conical tapered portion 17*a*, which is moved into contact with or away from the sub valve seat portion 23 that is the edge portion at the upper end of the release through-hole 16A, the waist portion 17*b* having the intermediate large-diameter latch portion 17*c* formed thereon, a truncated conical portion 17*e*, and a top small-diameter portion 17*d* that is inserted in and supported by the recess of the lower stopper 43. The tapered portion 17*a* serves as the sub valve element portion that opens or closes the in-valve release passage 16. Herein, the sub valve seat portion 23 and the sub valve element portion 17*a* form the sub valve unit 12. In the present example, a portion below the intermediate large-diameter latch portion 17*c* of the waist portion 17 is inserted into the insertion hole 37*b* of the plunger 37 with a small gap therebetween, and a portion above the intermediate large-diameter latch portion 17*c* and below the attractor (a portion arranged inside the cylindrical upper half portion 37A) has a slightly larger diameter than those of the other portions.

The dimensions and the shape of each part around the sub valve element 17 (e.g., a gap between the waist portion 17*b* and the insertion hole 37*b*) are designed such that even when the sub valve element 17 is slightly tilted at a position where it has been moved upward with respect to the main valve element 15 (i.e., a position where the in-valve release passage 16 is open), the lower end portion of the sub valve element portion (a tapered portion) 17*a* in an inverted conical shape enters the release through-hole 16A, and the sub valve element 17 is thus aligned with the main valve element 15 by the sub valve element portion 17*a* as the sub valve element 17 moves closer to the main valve element 15 (i.e., when the sub valve element 17 closes the in-valve release passage 16). More specifically, the dimensions and the shape of each part are designed such that part of the sub valve element portion 17*a* in an inverted conical shape is located in the release through-hole 16A when the sub valve element 17 is at the highest elevated position with respect to the main valve element 15 (see FIG. 3, in particular).

When the valve element 10 (the main valve element 15 and the sub valve element 17) and the plunger 37 are assembled, for example, the main valve element 15 is moved horizontally with respect to the plunger 37 so that the flanged latch portion 15*k* and the top small-diameter portion 15*f* of the main valve element 15, which has been assembled in advance to the valve body 20 (or a guide hole 19 thereof), are inserted into the cut-in 37*t* and the slit 37*s* of the plunger 37, respectively, and the top small-diameter portion 15*f* is fitted and inserted into the insertion hole 37*b* provided in the center of the plunger 37, and thereafter, the sub valve element 17 (or a portion below the intermediate large-diameter latch portion 17*c* thereof) may be inserted into the insertion hole 37*b* from above.

Meanwhile, the valve body 20 has a two-split structure that includes a body member 20A having a fit recess hole 20C in the center at the top thereof, and a support member 20B that is fixedly inserted into the recess hole 20C by press fitting or the like.

The support member 20B is produced from a material with relatively high hardness, such as stainless steel (SUS), and has a protruding stopper portion 24A for defining the lowest position of the plunger 37, on the upper side of a fit-insertion portion 24 that is fitted and inserted in the recess hole 20C. In addition, the guide hole 19 (an upper guide hole 19A) into which the top fit-insertion portion 15*e* of the main valve element 15 is slidably fitted and inserted is formed in the center of the support member 20B such that it penetrates the support member 20B in the vertical direction, and the lower end portion of the upper guide hole 19A serves as the valve orifice 22 (a valve seat portion) that is opened or closed by the main valve element portion 15*a* of the main valve element 15. Herein, the main valve element portion 15*a* and the valve orifice 22 form a main valve unit 11. As the support member 20B is produced from a material with high hardness, such as stainless steel, as described above, the specific gravity of the support member 20B is also high.

The body member 20A is produced from a material, such as aluminum, brass, or resin, that has relatively low specific gravity (a material with relatively low hardness) as compared to stainless steel and the like. An inlet/outlet chamber 28 for the suction pressure Ps in the compressor 100 is formed around the outer periphery of the stopper portion 24A, and a plurality of Ps inlet/outlet ports 27 are formed around the outer peripheral side of the inlet/outlet chamber 28 in a state in which the support member 20B (or the fit-insertion portion 24 thereof) is inserted in the recess hole 20C of the body member 20A. The suction pressure Ps introduced into the inlet/outlet chamber 28 from the Ps inlet/outlet ports 27 is introduced into the pressure-sensitive chamber 45 via the slit 37*s* and the cut-in 37*t* formed at the bottom of the plunger 37, a gap formed between the waist portion 17*b* of the sub valve element 17 and the insertion hole 37*b* of the plunger 37, a gap 36 formed between the outer periphery of the plunger 37 and the guide pipe 35, and the like.

A reception hole 18, which has a larger diameter than those of the guide hole 19 and the main valve element portion 15*a* and has a smaller diameter than that of the recess hole 20C and is adapted to store the main valve element portion 15*a* of the main valve element 15, is provided continuously with the center of the bottom of the recess hole 20C of the body member 20A, and the guide hole 19 (a lower guide hole 19B) into which the bottom fit-insertion portion 15*b* of the main valve element 15 is slidably fitted and inserted is formed in the center of the bottom of the reception hole 18. A valve closing spring 50 constructed form a conical compression coil spring is provided in a compressed state between the corner on the outer periphery of the bottom of the reception hole 18 and a stepped portion (terrace portion) 15*g* provided on the outer periphery of the bottom of the main valve element portion 15*a* of the main valve element 15. Thus, with the urging force of the valve closing spring 50, the main valve element 15 (or a step portion between the top fit-insertion portion 15*e* and the top small-diameter portion 15*f* thereof) is pressed against the plunger 37.

The inside of the reception hole 18 (a portion below the valve orifice 22 of the support member 20B) is the valve chamber 21. The valve chamber 21 has a plurality of Pd introduction ports 25 communicating with a discharge chamber 106 of the compressor 100. A ring-like filter member 25A is arranged around the outer periphery of the Pd introduction ports 25 of the body member 20A.

The lower end portion of the body member 20A has a lid-like member 48, which functions as a filter, fixed thereto by engagement, press fitting, or the like. A Pc inlet/outlet chamber (inlet/outlet port) 26, which communicates with a crank chamber 104 of the compressor 100, is provided on the side above the lid-like member 48 below the main valve element 15. The Pc inlet/outlet chamber (inlet/outlet port) 26 communicates with the Pd introduction ports 25 via the release through-hole 16A→the horizontal holes 16*s*→a gap between the bottom of the upper guide hole 19A and the intermediate small-diameter portion 15*d*→a gap between the valve orifice 22 and the main valve element portion 15*a*→the valve chamber 21.

In addition, in this embodiment, the in-valve release passage 16 for releasing the pressure Pc in the crank chamber 104 to a suction chamber 107 of the compressor 100 via the Ps inlet/outlet ports 27 is formed by the release through-hole 16A formed in the main valve element 15, the cut-in 37*t* and the slit 37*s* provided in the plunger 37, the inlet/outlet chamber 28, and the like. The in-valve release passage 16 is adapted to be opened or closed as the sub valve element portion 17*a* of the sub valve element 17 is moved into contact with or away from the sub valve seat portion 23 that is the upper end portion of the release through-hole 16A of the main valve element 15.

Herein, in the control valve 1 in this embodiment, when the plunger 37, the main valve element 15, and the sub valve element 17 are at the lowest position (when the bottom end surface of the plunger 37 abuts the stopper portion 24A, the main valve unit 11 is in the fully open position, and the sub valve unit 12 is in the fully closed position) as shown in FIG. 1, the clearance in the vertical direction between the main valve element portion 15*a* of the main valve element 15 and the valve orifice 22 (valve seat portion) is represented by a first lift amount Lv, and the clearance between the inner flanged latch portion 37*k* of the plunger 37 and the flanged latch portion 15*k* of the main valve element 15 is represented by a predetermined amount La. The maximum lift amount (second lift amount) Lp of the plunger 37 (the lift amount of from the lowest position to the highest position of the plunger 37) corresponds to the first lift amount Lv+the predetermined amount La.

Next, the operation of the control valve 1 with the aforementioned configuration will be generally described.

At the normal control time (Pd→Pc control time), the lift amount of the plunger 37 is slightly greater than the first lift amount Lv at the maximum, and at the compressor actuation time (Pc→Ps control time), the lift amount of the plunger 37 is the second lift amount Lp.

That is, at the normal control time (Pd→Pc control time), when the solenoid portion 30A including the coil 32, the stator 33, the attractor 34, and the like is supplied with current and energized, the plunger 37 is attracted by the attractor 34, and along with this, the intermediate large-diameter latch portion 17*c* of the sub valve element 17 is latched to the latch portion 37*a* of the plunger 37. Thus, the sub valve element 17 moves upward integrally with the plunger 37, and following the movement of the sub valve element 17, the main valve element 15 is moved upward (in the direction to close the valve) by the urging force of the valve closing spring 50. Meanwhile, the suction pressure Ps introduced into the Ps inlet/outlet ports 27 from the compressor 100 is introduced into the pressure-sensitive chamber 45 from the inlet/outlet chamber 28 via the slit 37*s* and the cut-in 37*t* of the plunger 37 and the like, and the bellows device 40 (the inside thereof is at a vacuum pressure) is expansively or contractively displaced in accordance with the pressure (suction pressure Ps) in the pressure-sensitive chamber 45 (contracts if the suction pressure Ps is high, and expands if it is low), and the displacement is then transmitted to the main valve element 15 via the plunger 37 and the sub valve element 17, whereby the valve opening (the clearance between the valve orifice 22 and the main valve element portion 15*a*) is regulated, and the pressure Pc in the crank chamber 104 is controlled in accordance with the valve opening. Along with this, the inclination angle of the swash plate 102 and the stroke of the piston 105 in the compressor 100 are controlled to increase or decrease the discharge capacity.

In this case, the main valve element 15 is always urged upward by the urging force of the valve closing spring 50, while the sub valve element 17 is always urged downward by the urging force of the valve opening spring 47. Therefore, the sub valve element portion 17*a* is in a state of being pressed against the sub valve seat portion 23 (the sub valve unit 12 is closed), and the in-valve release passage 16 is blocked in the main valve element 15. Therefore, there is no possibility that the crank chamber pressure Pc may be released to the suction chamber 107 via the in-valve release passage 16.

In contrast, at the compressor actuation time, the solenoid portion 30A is supplied with current and energized, and the plunger 37 is attracted by the attractor 34 so that the sub valve element 17 moves upward together with the plunger 37. Following such vertical movement of the sub valve element 17, the main valve element 15 is also moved upward and the valve orifice 22 is closed by the main valve element portion 15*a* of the main valve element 15. After that, the plunger 37 is further moved upward, whereby the sub valve element 17 is caused to open the in-valve release passage 16. Thus, the pressure Pc in the crank chamber 104 is released into the suction chamber 107 via two passages that are an in-compressor release passage 108 and the in-valve release passage 16.

Specifically, until the upward movement amount of the plunger 37 reaches the first lift amount Lv, the main valve element 15 moves in the direction to close the valve such that it follows the upward movement of the plunger 37 and the sub valve element 17 by the urging force of the valve closing spring 50. Then, when the upward movement amount reaches the first lift amount Lv, the valve orifice 20 is closed by the main valve element portion 15*a* of the main valve element 15 (the state shown in FIG. 2), and the plunger 37 is further moved upward by the predetermined amount La with the main valve unit 11 in the closed valve state (the state shown in FIG. 3). In other words, after the upward movement amount of the plunger 37 has reached the first lift amount Lv, the sub valve element 17 is elevated by the predetermined amount La until the inner flanged latch portion 37*k* of the plunger 37 is latched to the flanged latch portion 15*k* of the main valve element 15 (the first lift amount Lv+the predetermined amount La=the second lift amount Lp). In such a case, the main valve element 15 remains still in the closed valve state. Thus, the sub valve element portion 17*a* of the sub valve element 17 is lifted from the sub valve seat portion 23 by the predetermined amount La, whereby the in-valve release passage 16 is opened. When the inner flanged latch portion 37*k* of the plunger 37 is latched to the flanged latch portion 15*k* of the main valve element 15, neither the plunger 37 nor the sub valve element 17 is lifted any further even if the solenoid portion 30A generates an attraction force.

Herein, when the valve orifice 20 is closed by the main valve element portion 15*a* of the main valve element 15 (the states shown in FIGS. 2 and 3), the inside of the reception hole 18 (the inside of the valve chamber 21) communicating with the discharge chamber 106 of the compressor 100 via the Pd introduction ports 25 has a pressure higher than that in the Pc inlet/outlet chamber (inlet/outlet port) 26 communicating with the crank chamber 104. Therefore, the sealing member 14, which is vertically movably disposed in the annular groove 15*h* of the main valve element 15 such that it is arranged in the valve chamber 21, is pressed so as to be tightly in contact with an end portion on the valve chamber 21 side (higher pressure side) in a gap between sliding surfaces, which is formed between the bottom fit-insertion portion 15*b* (or the outer peripheral surface thereof) of the main valve element 15 and the lower guide hole 19B (or the inner peripheral surface thereof), due to the difference in pressure between the valve chamber 21 and the Pc inlet/outlet chamber (inlet/outlet port) 26 (herein, the outer peripheral portion of the sealing member 14 is made to abut the bottom surface (planar portion) of the reception hole 18 that forms the end portion on the valve chamber 21 side (higher pressure side) in the gap between the sliding surfaces). Thus, the sealing member 14 seals the gap between the sliding surfaces at a position between the valve chamber 21 and the Pc inlet/outlet chamber (inlet/outlet) 26.

It should be noted that in the shown example, the dimensions and the shape of the annular groove 15*h* of the main valve element 15 and the like are designed such that even when the valve orifice 20 is open (the state shown in FIG. 1), the sealing member 14 is made to abut the end portion on the valve chamber 21 side (higher pressure side) between the sliding surfaces. However, in such a state, it is not necessarily required to seal the end portion between the sliding surfaces because the Pd introduction ports 25 communicate with the Pc inlet/outlet chamber (inlet/outlet port) 26 via the valve chamber 21→a gap between the valve orifice 22 and the main valve element portion 15*a*→a gap between the bottom of the upper guide hole 19A and the intermediate small-diameter portion 15*d*→the horizontal holes 16*s*→the release through-hole 16A.

As described above, in the control valve 1 in this embodiment, the flexible or elastic sealing member 14 is disposed around the main valve element 15 of the valve element 10. The sealing member 14 is adapted to, when the valve orifice 22 is closed by the main valve element 15, abut an end portion on the higher pressure side in a gap between sliding surfaces, which is formed between the main valve element 15 (bottom fit-insertion portion 15*b*) (or the outer peripheral surface thereof) and the guide hole 19 (lower guide hole 19B) (or the inner peripheral surface thereof) into which the main valve element 15 is slidably fitted and inserted, and thus seal the gap between the sliding surfaces. Therefore, in comparison with the conventional art in which a sealing member such as an O-ring is disposed between a valve element and a guide hole, it is possible to suppress a decrease in the efficiency by reducing the amount of leakage in the valve without requiring severe accuracy of the components, avoid possible operation failures, such as a locked valve or a valve element that is left behind, and suppress the influence on the sliding resistance as well as the influence on the control characteristics.

Figure 6A:
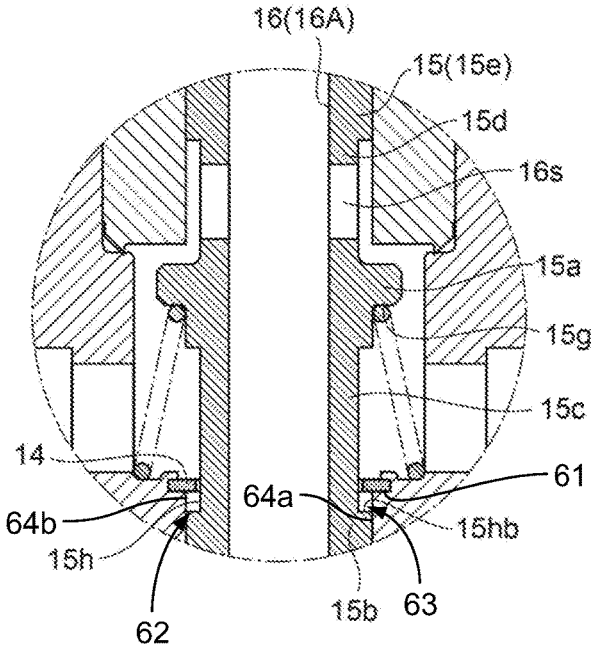
FIGS. 6A and 6B are enlarged sectional views of the main part showing a variation of the control valve in the first embodiment; specifically.
Figure 6B:
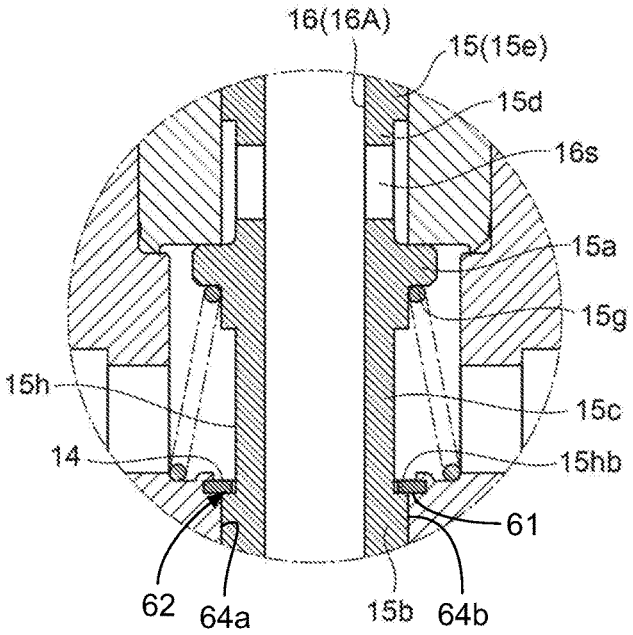

It should be noted that the aforementioned sealing member (packing) 14 for sealing the gap between the sliding surfaces may also be disposed on the side of the valve body 20 (or the body member 20A thereof) as shown in FIGS. 6A and 6B. In that case, the sealing member 14 is embedded at its inner peripheral portion in the annular groove 15*h* (in the shown example, the outer peripheral portion of the lower small-diameter portion 15*c* between the main valve element portion 15*a* and the bottom fit-insertion portion 15*b*) formed around the outer periphery of the valve element 10 (or the main valve element 15 thereof), while the sealing member 14 is attached at its outer peripheral portion to the valve body 20 (or the bottom surface of the reception hole 18 of the body member 20A thereof). Herein, the sealing member 14 may be fixed to the valve body 20 by crimping or the like as in the shown example, or may be vertically movably disposed on the valve body 20 as in the aforementioned embodiment. In addition, even in such a case, the sealing member 14 may have at least one cut-in formed in its inner peripheral portion or a partially cut-off portion (point) formed in its circumferential direction as described above.

As described above, even if the flexible or elastic sealing member 14 is disposed on the valve body 20, the sealing member 14 is adapted to abut an end portion on the higher pressure side in a gap between sliding surfaces, which is formed between the main valve element 15 (bottom fit-insertion portion 15*b*) (or the outer peripheral surface thereof) and the guide hole 19 (lower guide hole 19B) (or the inner peripheral surface thereof) into which the main valve element 15 is slidably fitted and inserted, and thus seal the gap between the sliding surfaces when the valve orifice 22 is closed by the main valve element 15. Therefore, operational effects similar to those of the control valve 1 in the aforementioned embodiment can be obtained.

Second Embodiment

Figure 7A:
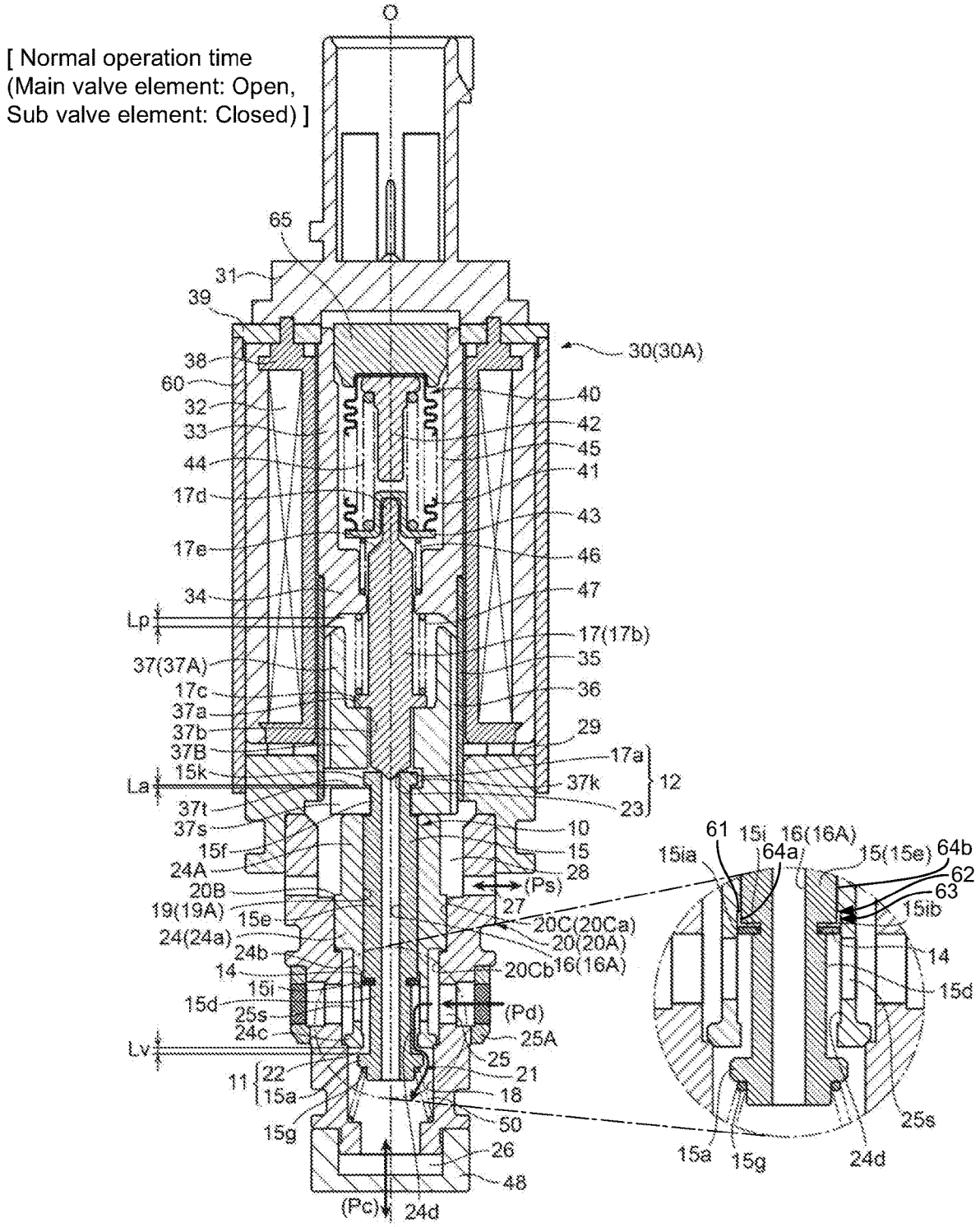
FIG. 7A is a longitudinal sectional view showing the second embodiment of the variable-capacity compressor control valve in accordance with the present invention in which the main valve element is in the open position and the sub valve element is in the closed position (at the normal control time)
Figure 7B:
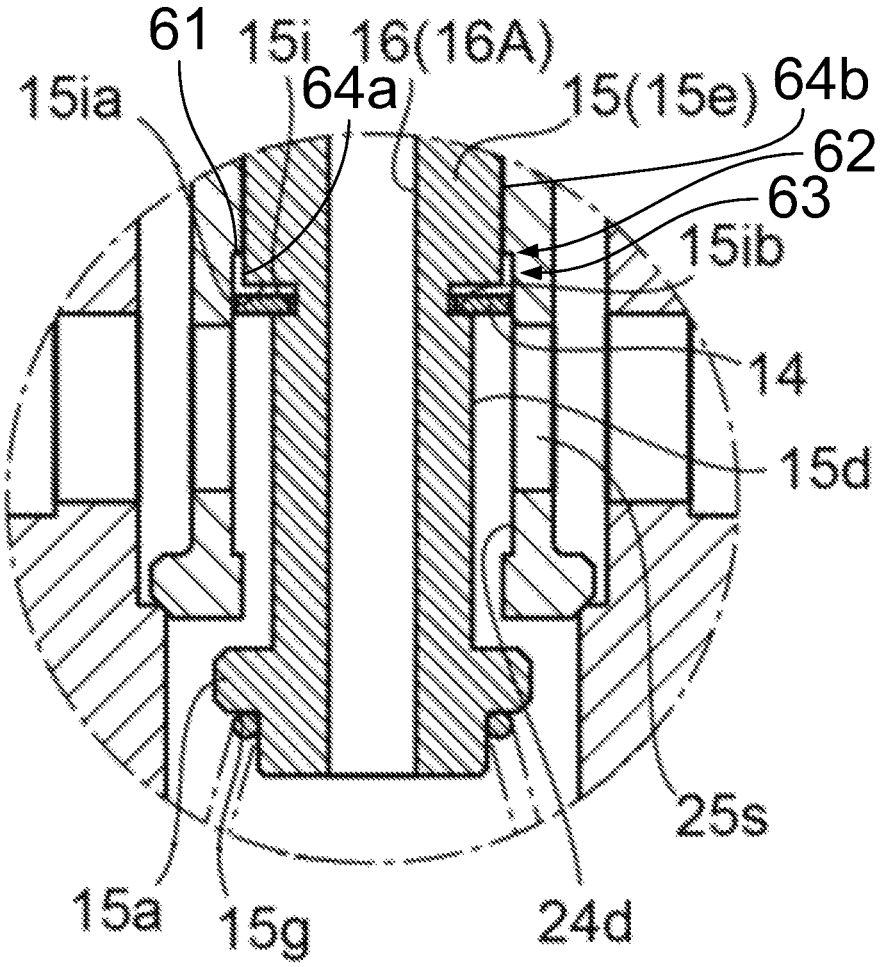
FIG. 7B is a detailed view of the second embodiment of the variable-capacity compressor control valve in accordance with the present invention.
Figure 8:
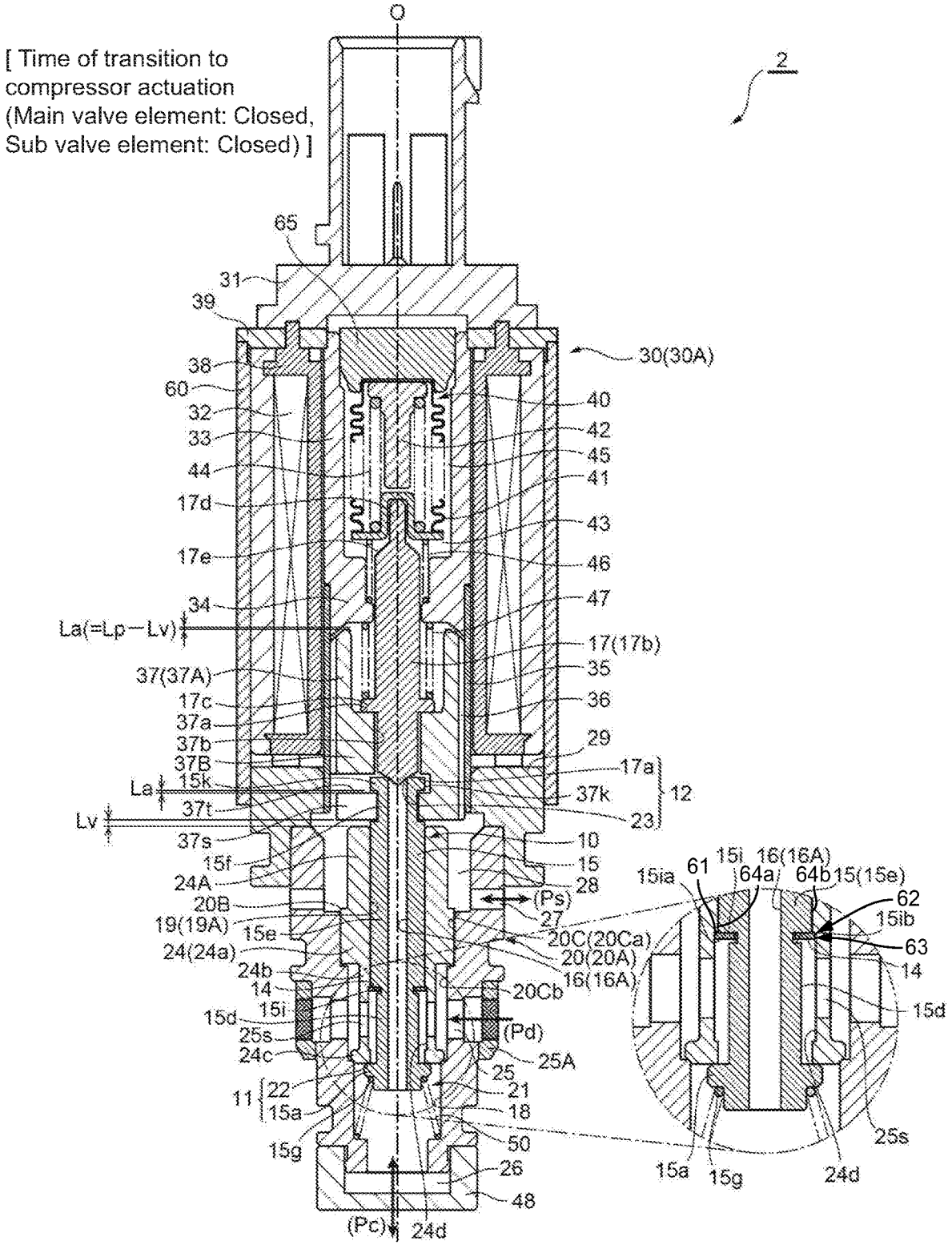
FIG. 8 is a longitudinal sectional view showing the second embodiment of the variable-capacity compressor control valve in accordance with the present invention in which the main valve element is in the closed position and the sub valve element is in the closed position (at the time of transition to compressor actuation).
Figure 9:
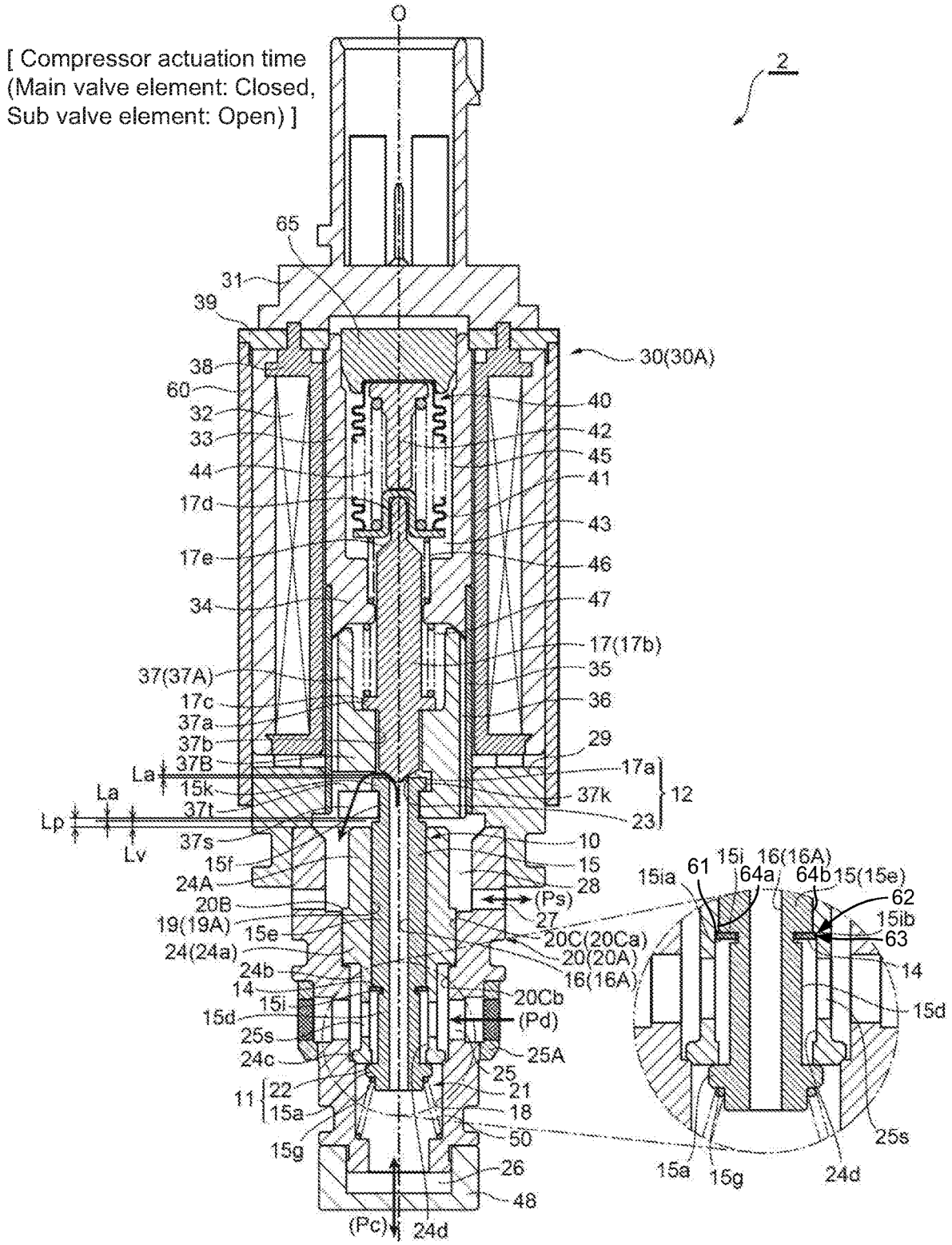
FIG. 9 is a longitudinal sectional view showing the second embodiment of the variable-capacity compressor control valve in accordance with the present invention in which the main valve element is in the closed position and the sub valve element is in the open position (at the compressor actuation time).
Figure 10:
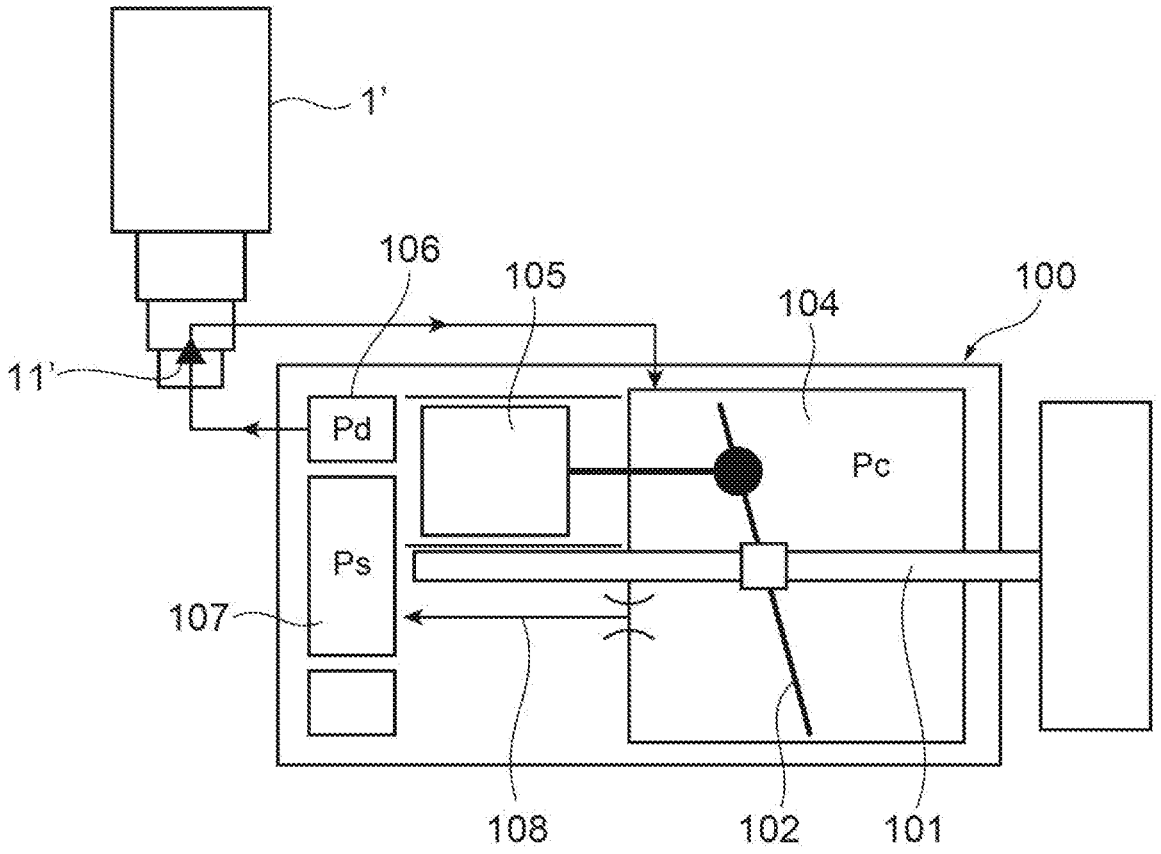
FIG. 10 is a view showing the circulation of state of a refrigerant pressure between a compressor and a control valve of the first conventional art.
Figure 11A:
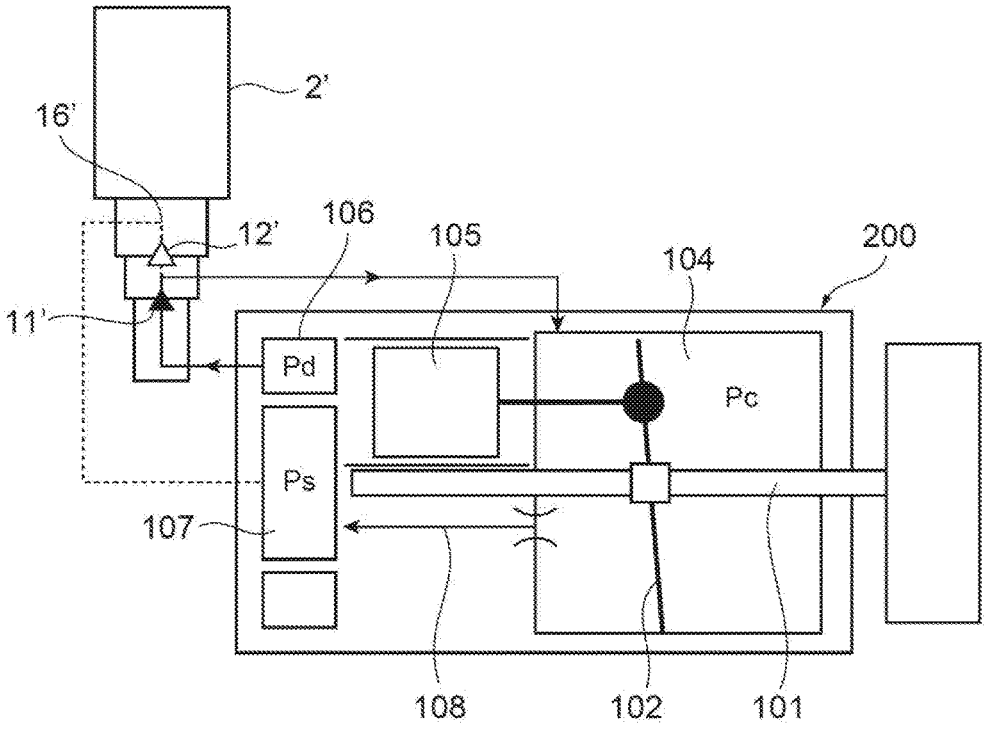
FIGS. 11A and 11B are views each showing the circulation state of a refrigerant pressure between a compressor and a control valve of the second conventional art; specifically.
Figure 11B:
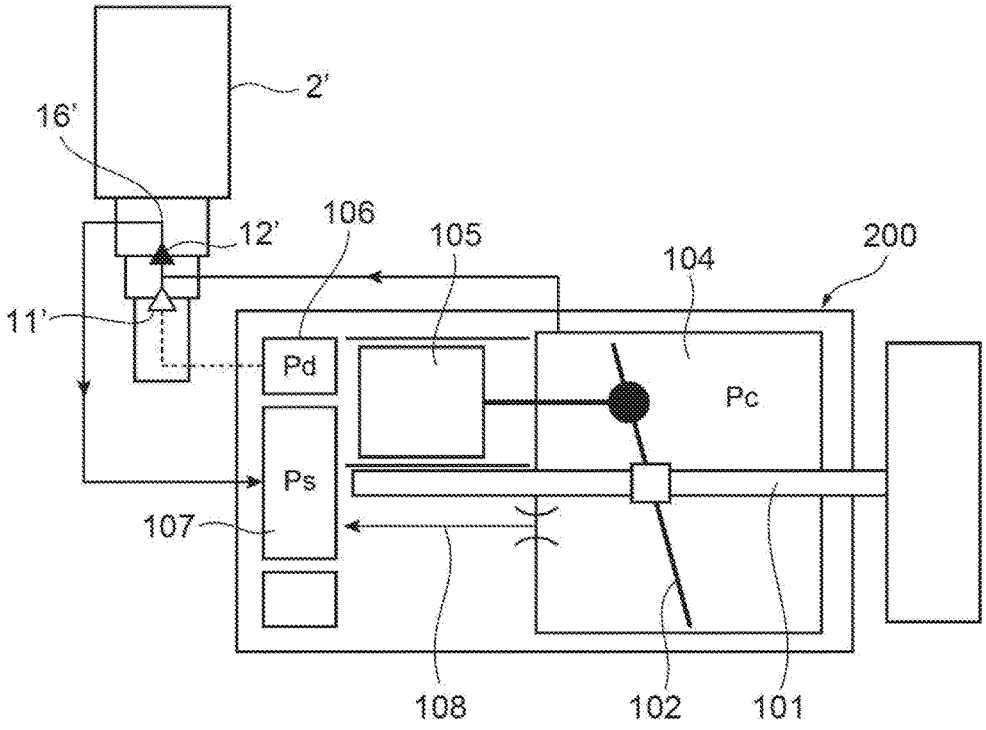

FIGS. 7A to 9 are longitudinal sectional views each showing the second embodiment of the variable-capacity compressor control valve in accordance with the present invention. Specifically, FIGS. 7A-7B are views in which the main valve element is in the open position and the sub valve element is in the closed position (at the normal control time); FIG. 8 is a view in which the main valve element is in the closed position and the sub valve element is in the closed position (at the time of transition to compressor actuation), and FIG. 9 is a view in which the main valve element is in the closed position and the sub valve element is in the open position (at the compressor actuation time).

The control valve 2 in the second embodiment basically differs from the control valve 1 in the aforementioned first embodiment only in the configurations of the valve body and the main valve element of the valve element. Thus, configurations with the same functions as those in the first embodiment are denoted by the same reference numerals and the detailed description thereof will thus be omitted. Hereinafter, only the differences will be discussed in detail.

In the control valve 2 in this embodiment, the top fit-insertion portion 15*e* and the intermediate small-diameter portion 15*d* of the main valve element 15 are formed longer than those of the control valve 1 in the first embodiment, while the lower small-diameter portion 15*c* and the bottom fit-insertion portion 15*b* on the lower side of the main valve element portion 15*a* are omitted.

In addition, an annular groove 15*i* is formed around the outer periphery of the upper end of the intermediate small-diameter portion 15*d* (or the outer periphery of the lower end of the top fit-insertion portion 15*e*) of the main valve element 15, and a sealing member (packing) 14 similar to that in the first embodiment is disposed in the annular groove 15*i* such that it is vertically movable to some extent.

In the present example, the annular groove 15*i* is formed such that when the valve orifice 22 is in the fully open state (when the main valve element 15 is at the lowest position, see FIG. 1), a lower surface 15*ib* of the annular groove 15*i* is located above horizontal holes 25*s* (which will be described in detail below) provided on the side of the lower small-diameter portion 24*b* of the fit-insertion portion 24 of the support member 20B of the valve body 20, and when the valve orifice 22 is closed (when the main valve element 15 is at the highest elevated position, see FIGS. 2 and 3), an upper planar surface 15*ia* of the annular groove 15*i* is substantially flush with the upper planar surface 61 (planar portion) of an inner peripheral groove 24*d* (which will be described in detail below) provided around the inner periphery of the lower small-diameter portion 24*b* of the fit-insertion portion 24.

The fit-insertion portion 24 of the support member 20B of the valve body 20 has a step formed thereon, and at a position below an upper large-diameter portion 24*a* (an outer shape corresponding to the fit-insertion portion 24 in the first embodiment), a lower small-diameter portion 24*b*, which is longer than the upper large-diameter portion 24*a* in the vertical direction, is provided, and at a lower end of the lower small-diameter portion 24*b*, a flanged abutment portion 24*c* adapted to abut the stepped portion (terrace portion) between the recess hole 20C and the reception hole 18 of the body member 20A is provided such that it protrudes outward.

The lower small-diameter portion 24*b* of the fit-insertion portion 24 has formed around its inner periphery the inner peripheral groove 24*d*, which is long in the vertical direction, so as to receive the outer peripheral portion, which protrudes from the annular groove 15*i*, of the sealing member 14 disposed in the annular groove 15*i*.

Meanwhile, the recess hole 20C of the body member 20A of the valve body 20 also has a step formed thereon, and has an upper large-diameter hole 20Ca (an outer shape corresponding to the recess hole 20C in the first embodiment) into which the upper large-diameter portion 24*a* is fitted and inserted, and a lower small-diameter hole 20Cb into which the lower small-diameter portion 24*b* is fitted and inserted, and further has a stepped reception hole 18 for storing the main valve element portion 15*a* of the main valve element 15 in a manner continuous with the center of the bottom of the lower small-diameter hole 20Cb. A valve closing spring 50 constructed from a conical compression coil spring is provided in a compressed state between the stepped portion provided on the inner periphery of the reception hole 18 and the stepped portion (terrace portion) 15*g* provided on the outer periphery of the bottom of the main valve element portion 15*a* of the main valve element 15.

The inside of the reception hole 18 (a portion below the valve orifice 22 of the support member 20B) is the valve chamber 21. Herein, the lower small-diameter hole 20Cb in the recess hole 20C has a plurality of Pd introduction ports 25 communicating with the discharge chamber 106 of the compressor 100. A ring-like filter member 25A is arranged around the outer periphery of the Pd introduction ports 25 thereof, and the lower small-diameter portion 24*b* of the fit-insertion portion 24 (instead of the intermediate small-diameter portion 15*d* of the main valve element 15) has a plurality of horizontal holes 25*a* communicating with the Pd introduction ports 25. The Pc inlet/outlet chamber (inlet/outlet port) 26, which communicates with the crank chamber 104 of the compressor 100, communicates with the Pd introduction ports 25 via the valve chamber 21→a gap between the valve orifice 22 and the main valve element portion 15*a*→a gap between the bottom of the guide hole 19 (upper guide hole 19A) and the intermediate small-diameter portion 15*d*→the horizontal holes 25 in the lower small-diameter portion 24*b*→a gap between the lower small-diameter portion 24*b* and the lower small-diameter hole 20Cb (which will be discussed in detail below).

In addition, in this embodiment, the outer periphery of the upper large-diameter portion 24*a* abuts the inner periphery of the upper large-diameter hole 20Ca (that is, the upper large-diameter portion 24*a* is fitted into (fits snugly inside) the upper large-diameter hole 20Ca), and the support member 20B is fixedly inserted into the recess hole 20C of the body member 20A in a posture in which a small gap is provided between the outer periphery of the lower small-diameter portion 24*b* and the inner periphery of the lower small-diameter hole 20Cb.

In the control valve 2 in this embodiment also, when the valve orifice 20 is closed by the main valve element portion 15*a* of the main valve element 15 (the states shown in FIGS. 8 and 9), the inside of the lower small-diameter hole 20Cb communicating with the discharge chamber 106 of the compressor 100 via the Pd introduction ports 25 has a pressure higher than that in the inlet/outlet chamber 28 communicating with the suction chamber 107 of the compressor 100 via the Ps inlet/outlet ports 27. Therefore, the sealing member 14, which is vertically movably disposed in the annular groove 15*i* of the main valve element 15 such that it is arranged in the lower small-diameter hole 20Cb, is pressed so as to be tightly in contact with an end portion 62 on the lower small-diameter hole 20Cb side (higher pressure side) in a gap 63 between sliding surfaces 64*a*, 64*b*, which is formed between the top fit-insertion portion 15*e* (or the outer peripheral surface thereof) of the main valve element 15 and the guide hole 19 (upper guide hole 19A) (or the inner peripheral surface thereof), due to the difference in pressure between the lower small-diameter hole 20Cb and the inlet/outlet chamber 28 (herein, the outer peripheral portion of the sealing member 14 is made to abut the upper planar surface 61 (planar portion) of the inner peripheral groove 24*d* that forms the end portion 62 on the lower small-diameter hole 20Cb side (higher pressure side) in the gap 63 between the sliding surfaces 64*a*, 64*b*). Thus, the sealing member 14 seals the gap 63 between the sliding surfaces 64*a*, 64*b* at a position between the lower small-diameter hole 20Cb and the inlet/outlet chamber 28.

Therefore, the control valve 2 in the second embodiment with the aforementioned configuration can also obtain operational effects similar to those of the control valve 1 in the first embodiment.

It should be noted that in the second embodiment, the dimensions and the shape of the annular groove 15*i* of the main valve element 15 and the like are designed such that when the valve orifice 20 is opened (the state shown in FIGS. 7A-7B), the sealing member 14 is separated from the end portion 62 on the lower small-diameter hole 20Cb side (higher pressure side) in the gap 63 between the sliding surfaces.

The first and second embodiments have adopted the control valves 1 and 2 of a type in which the valve element 10 includes the main valve element 15 and the sub valve element 17, and the pressure Pc in the crank chamber 104 of the compressor 100 is released to the suction chamber 107 via the Ps inlet/outlet ports 27 using the in-valve release passage 16 (release through-hole 16A) formed in the main valve element 15. However, it is needless to mention that the present invention can also be applied to a control valve of a type in which the main valve element 15 and the sub valve element 17 of the valve element 10 are integrally formed and the release through-hole in the main valve element 15 (and the in-valve release passage accordingly) is omitted (see Patent Document 1, for example).

DESCRIPTION OF SYMBOLS

1 Variable-capacity compressor control valve (first embodiment)
2 Variable-capacity compressor control valve (second embodiment)
10 Valve element
11 Main valve unit
12 Sub valve unit
14 Sealing member
15 Main valve element
15*a* Main valve element portion
15*h* Annular groove (first embodiment)
15*i* Annular groove (second embodiment)
15*k* Flanged latch portion
16 In-valve release passage
17 Sub valve element
17*a* Sub valve element portion (tapered portion)
19 Guide hole
19A Upper guide hole
19B Lower guide hole
20 Valve body
20A Body member
20B Support member
20C Recess hole
21 Valve chamber
22 Valve orifice
23 Sub valve seat portion
25 Pd introduction port
26 Pc inlet/outlet port
27 Ps inlet/outlet port
30 Electromagnetic actuator
30A Solenoid portion
37 Plunger
37*k* Inner flanged latch portion
37*s* Slit
37*t* Cut-in
40 Bellows device (pressure-sensitive reaction member)
45 Pressure-sensitive chamber
50 Valve closing spring
Lv First lift amount
La Predetermined amount
Lp Second lift amount

What is claimed is:

1. A variable-capacity compressor control valve comprising: a valve body including a valve chamber with a valve orifice, a Ps inlet/outlet port communicating with a suction chamber of a compressor, a Pd introduction port communicating with a discharge chamber of the compressor, and a Pc inlet/outlet port communicating with a crank chamber of the compressor; a valve element adapted to open the valve orifice; an electromagnetic actuator with a plunger for moving the valve element in a direction to open the valve orifice; a pressure-sensitive chamber; and a pressure-sensitive reaction member adapted to urge the valve element in the direction to open the valve orifice in accordance with a pressure in the pressure-sensitive chamber, wherein the valve element is adapted to be slidably fitted and inserted into a guide hole provided in the valve body, the valve element and the valve body including sliding surfaces, each of the valve element and the valve body including a planar surface on an end portion on a higher pressure side in a gap between the valve element and the valve body sliding surfaces, the planar surface of the valve element and the planar surface of the valve body form planar surfaces that are substantially flush with each other in a closed valve state in which the valve orifice is closed by the valve element, and are separated in a stepped manner relative to each other in an open valve state in which the valve orifice is opened by the valve element, one of the valve element or the valve body is provided with a flexible or elastic sealing member, the sealing member being adapted to abut the substantially flush planar surfaces of the valve element and the valve body in the closed valve state to cover the gap between the sliding surfaces, and the sealing member abuts the substantially flush planar surfaces due to a pressure on the higher pressure side so as to seal the gap between the sliding surfaces in the closed valve state, and is away from the planar surface of the valve element or the valve body due to a separation in the stepped manner in the open valve state.

2. The variable-capacity compressor control valve according to claim 1, wherein the sealing member is disposed in an annular groove, the annular groove being provided around an outer periphery of the valve element.

3. The variable-capacity compressor control valve according to claim 2, wherein the sealing member has a ring shape in which an inner peripheral portion of the sealing member is embedded in the annular groove and an outer peripheral portion of the sealing member protrudes from the annular groove.

4. The variable-capacity compressor control valve according to claim 3, wherein the sealing member has at least one cut-in formed in its inner peripheral portion.

5. The variable-capacity compressor control valve according to claim 3, wherein the sealing member has a partially cut-off portion in its circumferential direction.

6. The variable-capacity compressor control valve according to claim 2, wherein the sealing member is vertically movably disposed in the annular groove.

7. The variable-capacity compressor control valve according to claim 1, wherein the sealing member is disposed on the valve body.

8. The variable-capacity compressor control valve according to claim 7, wherein the sealing member has a ring shape in which an inner peripheral portion of the sealing member is embedded in an annular groove that is provided around an outer periphery of the valve element, and an outer peripheral portion of the sealing member is attached to the valve body.

9. The variable-capacity compressor control valve according to claim 8, wherein the sealing member has at least one cut-in formed in its inner peripheral portion.

10. The variable-capacity compressor control valve according to claim 8, wherein the sealing member has a partially cut-off portion in its circumferential direction.

11. The variable-capacity compressor control valve according to claim 7, wherein the sealing member is fixed to the valve body or is vertically movably disposed on the valve body.

12. The variable-capacity compressor control valve according to claim 1, wherein the end portion on the higher pressure side in the gap between the sliding surfaces has the planar surface, and the sealing member is adapted to abut the planar surface.

13. The variable-capacity compressor control valve according to claim 1, wherein the sealing member is adapted to be separated from the end portion on the higher pressure side in the gap between the sliding surfaces when the valve orifice is open.

14. The variable-capacity compressor control valve according to claim 1, wherein the valve element includes a main valve element and a sub valve element, the main valve element being adapted to open or close the valve orifice and having formed therein an in-valve release passage for releasing a pressure Pc in the crank chamber to the suction chamber of the compressor via the Ps inlet/outlet port, and the sub valve element being adapted to open or close the in-valve release passage, and the sealing member is disposed on the main valve element that is adapted to be fitted and inserted into the guide hole.

15. The variable-capacity compressor control valve according to claim 1, wherein an inner peripheral groove is formed in the valve body and defines the gap between the sliding surfaces of the valve element and the valve body.

16. The variable-capacity compressor control valve according to claim 15, wherein the inner peripheral groove includes an inner step formed by the planar surface on the end portion of the valve body.

17. The variable-capacity compressor control valve according to claim 16, wherein in the closed valve state, the sealing member is adapted to abut the planar surface of the inner step on the end portion of the inner peripheral groove, and thus seal the gap between the sliding surfaces.

18. The variable-capacity compressor control valve according to claim 15, wherein the sealing member is disposed in an annular groove provided around an outer periphery of the valve element, the inner peripheral groove of the valve body is dimensioned greater than the annular groove of the valve element in a vertical direction.

19. The variable-capacity compressor control valve according to claim 15, wherein the valve element includes a top portion, an intermediate small-diameter portion, and an annular groove formed in an outer peripheral of the valve element between the top portion and the intermediate small-diameter portion, a diameter of the top portion is dimensioned greater than a diameter of the intermediate small-diameter portion, and the sealing member is disposed in the annular groove of the valve element.

* * * * *